United States Patent [19]

Kobayashi et al.

[11] Patent Number: 4,796,547

[45] Date of Patent: Jan. 10, 1989

[54] FINE PARTICLE DISPERSING DEVICE FOR MIXING REACTANT WITH COMBUSTION GAS

[75] Inventors: Yoshio Kobayashi, Sennan; Chiaki Tojo, Sakai; Masayoshi Kinoshita, Nara, all of Japan

[73] Assignee: Hitachi Zosen Corporation, Osaka, Japan

[21] Appl. No.: 3,226

[22] Filed: Jan. 14, 1987

[30] Foreign Application Priority Data

Jan. 24, 1986 [JP] Japan ..... 61-13994
Jan. 28, 1986 [JP] Japan ..... 61-17332

[51] Int. Cl.[4] ..... F23D 1/00

[52] U.S. Cl. ..... 110/263; 110/264; 239/416.5; 239/424.5

[58] Field of Search ..... 239/428, 416.4, 416.5, 239/419.3, 424, 424.5, DIG. 7; 110/263, 264, 347; 431/178, 179, 180

[56] References Cited

U.S. PATENT DOCUMENTS 3,073,534 1/1963 Hampshire ..... 239/424 X
3,890,084 6/1975 Voorheis et al. ..... 431/179 X
4,284,239 8/1981 Ikeuchi ..... 239/419.3 X

*Primary Examiner*—Edward G. Favors
*Attorney, Agent, or Firm*—Barnes, Kisselle, Raisch, Choate, Wittemore & Hulbert

[57] ABSTRACT

A device for dispersing fine particles in the agglomerated state comprises a body, a fine particle channel provided in the body and terminating in a spout in the form of a slit, and a clearance provided in the body, inclined downstream with respect to the fine particle channel and communicating with the fine particle channel for emitting a gas into the fine particle channel. Since the spout is in the form of a slit, a large amount can be simultaneously dispersed without losing the dispersing performance of the single hole type dispersing device. When a plurality of such dispersing devices are attached to the combustion gas passage forming wall of a furnace and arranged so that the more upstream they are disposed, the greater is the throw of the reactant-containing gas emitted therefrom, the reactant is diffused in the combustion gas and uniformly distributed.

14 Claims, 14 Drawing Sheets

FINE PARTICLE DISPERSING DEVICE FOR MIXING REACTANT WITH COMBUSTION GAS

FIELD OF THE INVENTION

The present invention relates to a fine particle dispersing device employed when dispersing agglomerated fine particles, and also to a device for mixing a reactant with combustion gas which utilizes said dispersing device.

BACKGROUND OF THE INVENTION

Generally, as the particle size of fine particles decreases (to less than 10 μm in diameter), their agglomerating force becomes greater, with a plurality of particles sticking together to form an agglomerated particle which tends to behave as a coarse particle. Heretofore, a system using an ordinary orifice with a single hole or an ejector has been employed as an agglomerated particle dispersing device. With such conventional dispersing device, however, only a small amount of fine particles can be treated, thus an obstacle occurs to development of a large-sized classifier or a reactor of large capacity handling a large amount of fine particles.

According to the conventional single hole type dispersing device described above, when it is desired to increase the amount to be treated, the aperture diameter has to be increased, so that sufficient dispersion cannot be attained unless excessive power is applied. That is, the amount that can be treated by the state-of-the-art dispersing device for dispersing single particles having diameters of less than a few μm is limited (at the present stage; 30–50 kg/hr/unit).

SUMMARY OF THE INVENTION

An object of the present invention is to provide a fine particle dispersing device wherein the amount to be treated can be increased to a marked degree without requiring excessive power.

To achieve this object, a fine particle dispersing device according to the invention comprises a body, a fine particle channel formed in said body and terminating in a slit-like spout, and a gas feed channel inclined downstream with respect to the fine particle channel and communicating with the fine particle channel.

According to this arrangement, the gas inclinedly emitted downstream with respect to the fine particle channel produces an ejector action in the fine particle channel, whereby fine particles can be conveyed by suction and dispersed. In this case, since the spout is in the form of a slit, a large amount can be dispersed and there is no possibility of detracting from the dispersing performance possessed by the single hole type.

A device for mixing a reactant with combustion gas according to the invention comprises a plurality of dispersing means arranged at space intervals in the direction of the flow for emitting a reactant-containing gas in a direction which crosses the direction of flow of combustion gas, said dispersing means being arranged so that they emit said reactant-containing gas in such a manner that the more upstream they are disposed, the greater the throw.

DESCRIPTION OF THE PREFERRED EMBODIMENTS

Figure 1:
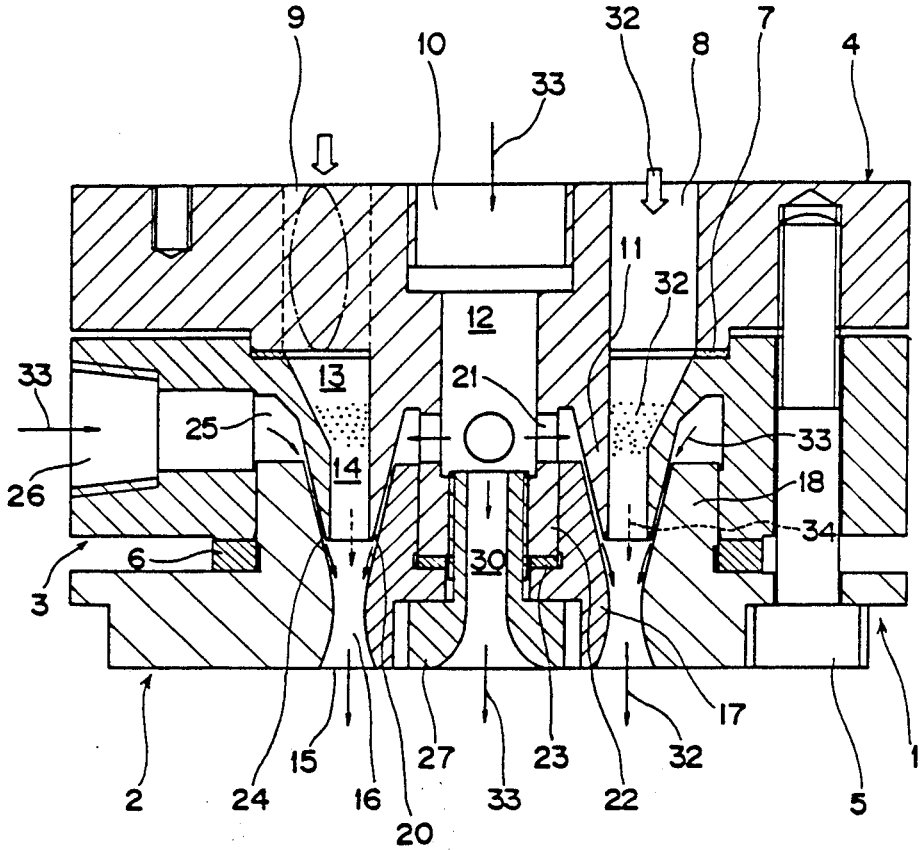
FIG. 1 is a sectional view of a dispersing device according to a first embodiment of the invention.

A first embodiment of the invention will now be described with reference to FIGS. 1 through 3.

A body 1 roughly in the form of a disk assembly comprises a emitting disk, a central piece 17 accommodated in the central part of said emitting disk 2, an intermediate disk 3 connected to the end of said emitting disk 2 by being fitted thereon, and a fine particle feeding disk 4 connected to the end of said intermediate disk 4 by being fitted therein, said disks 2, 3, and 4 being integrated together by bolts 5. A spacer 6 is interposed between the disks 2 and 3 and a packing 7 between the disks 3 and 4.

Feeding disk 4 is formed with an annular fine particle feeding passage 8. The fine particle feeding passage 8 is provided with a plurality of connectors 9 circumferentially spaced from each other, said connectors 9 integrating the central and peripheral portions of the disk 4. The disk 4 is formed with a first gas feeding port 10, and a cylindrical projection 11 formed on the disk 4 is internally formed with an inner gas reservoir 12.

The intermediate disk 3 is internally formed with an opening capable of receiving the projection 11 on the feeding disk 4, and an annular fine particle reservoir 13 defined between said opening and said projection 11. Extending from the fine particle reservoir 13 is an upstream annular channel 14 which opens at its end. The downstream annular channel 16 is formed between the disk 2 and the central piece 17, which is opposed to and communicating with the upstream annular channel 14 and has an open end that provides an annular spout 15. The downstream annual channel 16 has a throat portion and a bell-mouth portion in order to act as a diffuser of an ejector. Since the upstream and the downstream annular channels 14, 16 are defined by clearances between the disks 3 and 4, and between the disk 2 and the central piece 17, they are in the form of circumferentially uninterrupted, complete rings.

The emitting disk 2 is formed with a cylindrical projection 18 fitted in the intermediate disk 3

The central portion 17 is inserted in the projection 11 on the feeding disk 4. The end surface of the central piece 17 is centrally formed with a recess which receives the head of a nozzle bolt 27 which is fixedly screwed into the front central portion 22 of the feeding disk 4 to fasten the central piece 17 to the front central portion 22. The central piece 17 and the projection 11 are fitted together so that a tapered inner clearance 20 is defined between their central portions, said inner clearance 20 being inclined to the downstream center of the channel 16. The inner clearance 20 communicates with the inner gas reservoir 12 through a communication port 21 which extends through the projection 11. A spacer 23 for adjusting the cross-sectional area of the inner clearance 20 is interposed between the front central portion 22 of the feeding disk 4 and the central piece 17.

The wall of the fine particle reservoir 13 in the intermediate disk 3 is inserted in the annular channel 16 of the emitting disk 2. A tapered outer clearance 24 is defined between the projection 18 on the emitting disk 2 and the wall of the fine particle reservoir 13, said outer clearance 24, like the inner clearance 20, being inclined to the downstream central portion of the downstream annular channel 16 and communicating with said channel 16. The two clearances 20 and 24 are in the form of laval tubes to perform the function of a supersonic nozzle. The outer clearance 24 has its cross-sectional area adjusted by the spacer 6. In the intermediate disk 3, an annular outer gas reservoir 25 communicating with the outer clearance 24 is defined between the projection 18 on the emitting disk 2 and the intermediate disk 3. The intermediate disk 3 is formed with a second gas feeding port 26 communicating with the outer gas reservoir 25.

The nozzle bolt 27 is centrally formed with a nozzle hole 30 extending therethrough for communication with the inner gas reservoir 12 in the feeding disk 4. The nozzle bolt 27, the central piece 17 and the emitting disk 2 are arranged so that their end surfaces flush with each other.

Figure 2:
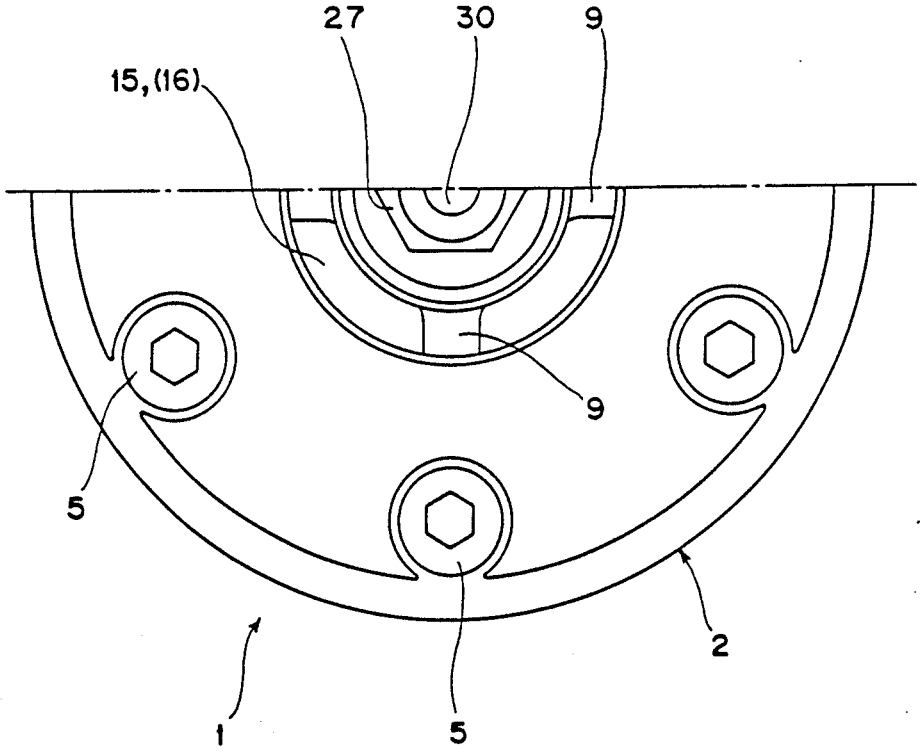
FIG. 2 is a bottom view of a portion of the dispersing device shown in FIG. 1.

In FIGS. 1 and 2, the numeral 32 denotes fine particles and 33 denotes a gas such as air.

To effect dispersion of the fine particles 32, a high pressure gas, e.g., at 2–3 kgf/cm$^2$ or above is fed to the two gas feeding ports 10 and 26. Thereupon, the gas 33 in the inner gas reservoir 12 is emitted into the downstream annular channel 16 through the inner clearance 20, while the gas 33 in the outer gas reservoir 25 is emitted into the channel 16 through the outer clearance 24, whereby an ejector action is produced in the spout region. At this time, the region in the vicinity of the opening of the upstream annular channel 14 has a negative pressure exerted therein, producing a gas flow 34 passing through the upstream annular channel 14.

Figure 3:
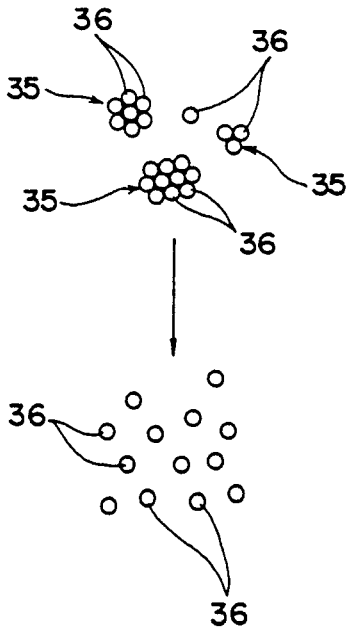
FIG. 3 is a view for explaining dispersion of fine particles.

In this state, when fine particles 32 are fed to the fine particle reservoir 13, they are carried by the gas flow 34 from the upstream annular channel 14 to the downstream annular channel 16, where they are subjected to a strong mixing and shearing flow of gas produced by the difference in speed between the low speed gas flow 34 from the upstream annular channel 14 and the high speed (supersonic) gas flow 33 emitted from the two clearances 20 and 24, whereby fine particles 35, which agglomerated as shown in FIG. 3, are dispersed to become single fine particles 36. With this type of dispersion, the amount to be treated can be greatly increased to more than 1 ton/hr/unit.

Figure 4:
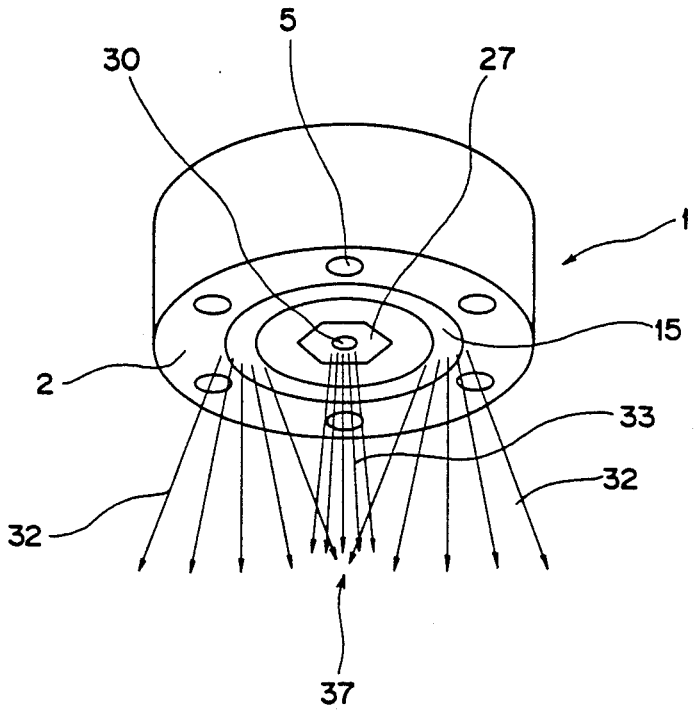
FIG. 4 is a perspective view showing how the dispersing device shown in FIG. 1 operates.

Fine particles 32 are emitted in ring form from the spout 15 of the downstream annular channel 16. In the inner side 37 of the emitted fine particles 32, high concentration aerosol particles interfere with each other; thus, there is a danger that dispersed particles agglomerate again. However, since the gas in the inner gas reservoir 12 is emitted through the nozzle hole 30 of the nozzle bolt 27 to the inner side 37 of the jet, as shown in FIG. 4, the high concentration dispersion phase is diluted with the gas 33, whereby dispersed fine particles are protected against re-agglomeration. Therefore, to provide a large amount of gas 33 for dilution, it is preferable that the cross sectional area (diameter) of the nozzle hole 30 be much larger than that of the spout 15. Further, increasing the diameter of the nozzle hole 30 as described will provide the effect of enabling the jet of aerosol to reach a farther location when the present device is used as a dispersing nozzle in the manner shown in FIG. 11 to be later described.

Figure 5:
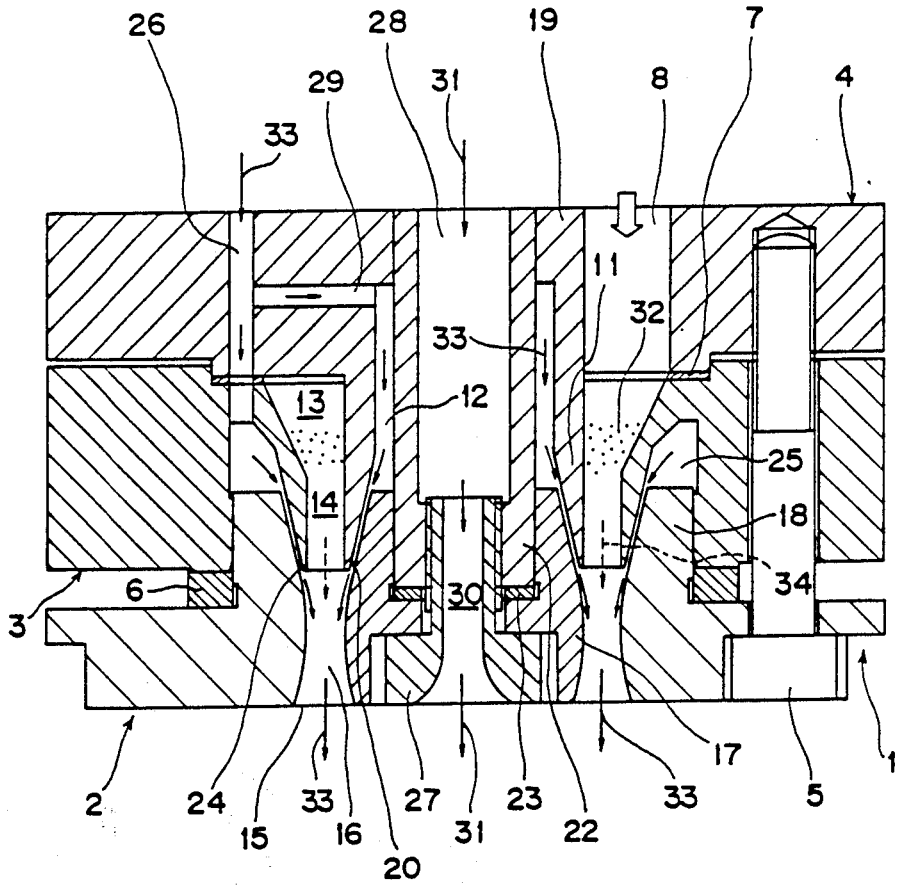
FIG. 5 is a sectional view of a dispersing device according to a second embodiment of the invention.

FIG. 5 shows a second embodiment which is a modification of the first embodiment. In this embodiment, a cylindrical body 19 is installed in the central portion of the feeding disk 4, said cylindrical body 19 providing a gas feeding passage 28 leading to the nozzle hole 30. The gas feeding passage 28 does not communicate with the inner gas reservoir 12 and it opens at the end surface of the feeding disk 4. The inner gas reservoir 12 is annularly formed around the outer periphery of the cylindrical body 19. The second gas feeding port 26 is directed from the end surface of the feeding disk 4 to the outer gas reservoir 25, and a branch passage 29 extending from said gas feeding port 26 is connected to the inner gas reservoir 12. In the feeding disk 4, the particle feeding passage 8 is not such an annular one as is shown in FIG. 1, but it is in the form of a plurality of circumferentially spaced holes extending from the end surface of the disk 4 to the fine particle reservoir 13. By making the particle feeding passage 8 of hole construction in this manner, a region required for forming the branch passage 29 is secured.

According to such arrangement, a gas such as air fed to the second gas feeding port 26 is distributed to the outer and inner gas reservoirs 25 and 12, and then emitted to the downstream annular channel 16 through the clearances 20 and 24. The gas feeding passage 28 is fed with gas 31 to be emitted from the nozzle hole 30. Since the feeding passage 28 is separated from the inner gas reservoir 12, the gas 31 may be one which differs from the gas 33 fed to the downstream annular channel 16. For example, as in FIG. 11 to be later described, when the present device is used as a nozzle for dispersing a reactant in combustion gas, said combustion gas can be fed as the gas 31.

Figure 6:
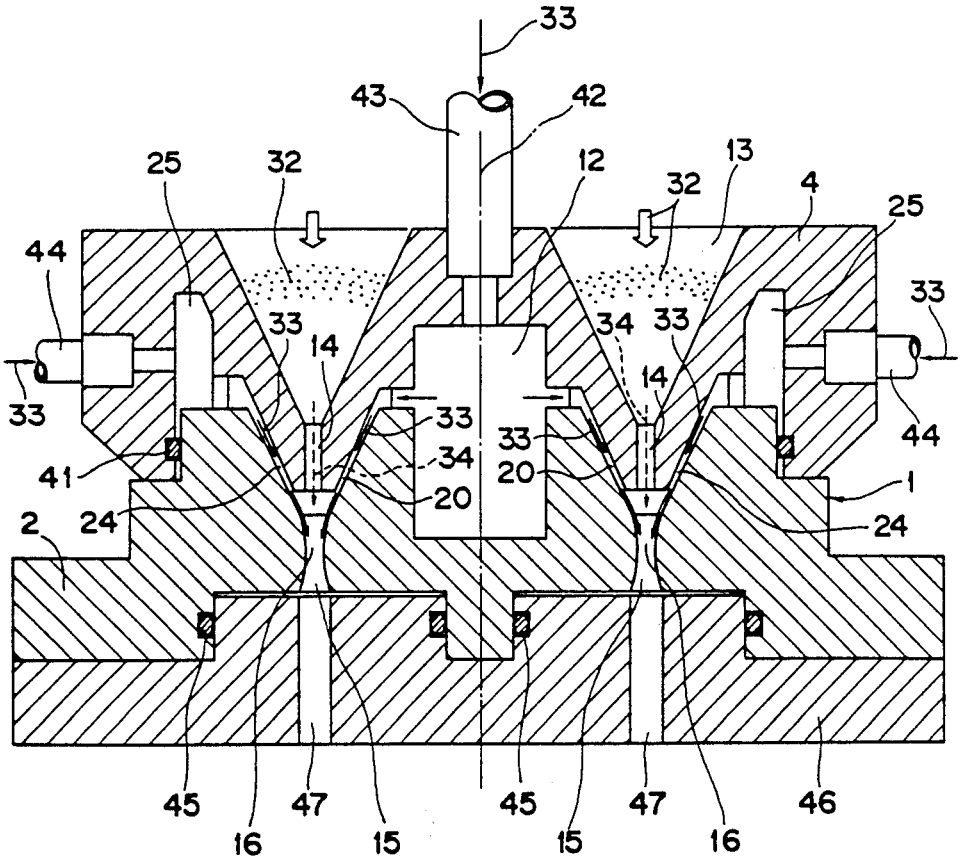
FIG. 6 is a sectional view of a dispersing device according to a third embodiment of the invention.
Figure 7:
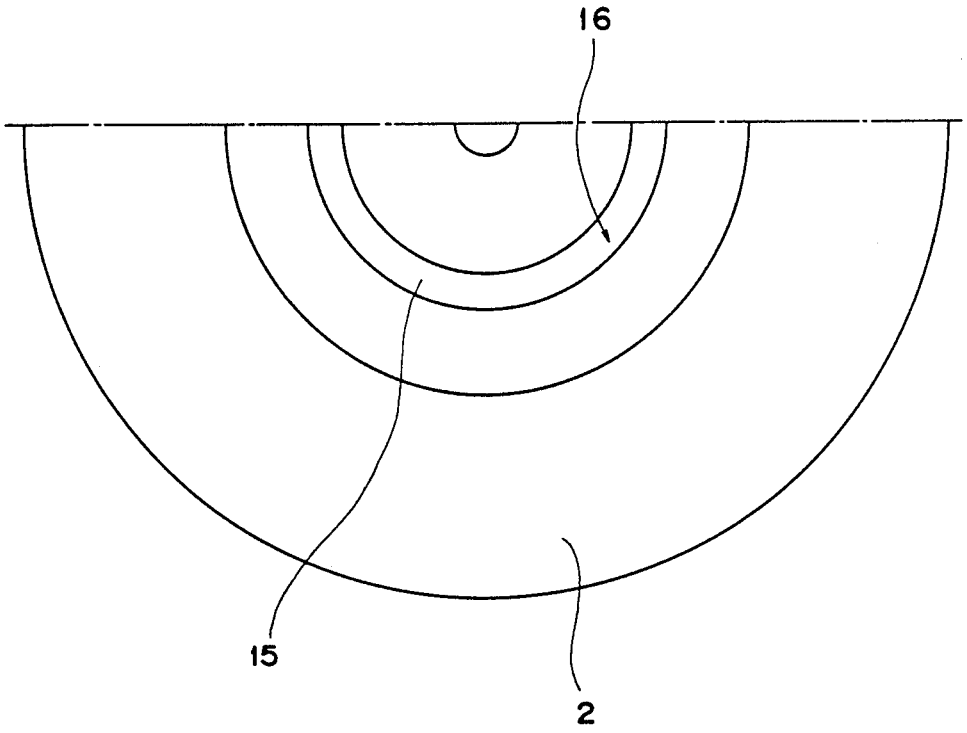
FIG. 7 is a bottom view of a portion of the dispersing device shown in FIG. 6, with a block plate removed.

FIGS. 6 and 7 shows a third embodiment which is a modification of the first embodiment. This embodiment omits the nozzle 30 used in the first embodiment and can be utilized where fine particle emitting conditions ensure that there is no danger that fine particles emitted from the spout 15 and thereby dispersed will agglomerate again.

In this embodiment, the body 1 comprises an emitting disk 2, and a fine particle feeding disk 4 connected to said emitting disk 2 by being fitted thereon through a sealing member 41. The feeding disk 4 is formed with an annular fine particle reservoir 13 positioned concentrically to the body axis 42, and extending from the fine particle reservoir 13 is an upstream annular channel 14 whose downstream end is opened. The emitting disk 2 is formed with a downstream annular channel 16 opposed to and communicating with the upstream annular channel 14. Each of the annular channels 14 and 16, has its outer and inner portions integrated together by circumferentially spaced connectors.

The fine particle reservoir 13 in the feeding disk 4 projects to the emitting disk 2 so that the projecting portion is inserted in an annular recess formed in the emitting disk 2. This fitting engagement forms an inner tapered clearance 20 and an outer tapered clearance 24.

An inner gas reservoir 12 is formed to be positioned on the body axis 42 and to extend across the opposed surfaces of the two disks 2 and 4. The inner gas reservoir 12 communicates with the inner end of the inner clearance 20 and with a first gas feeding tube 43 attached to the feeding disk 4. The feeding disk 4 is formed with an outer annular gas reservoir 25 disposed circumferentially outwardly of fine particle reservoir 13. The outer gas reservoir 25 communicates with the outer end of the outer clearance 24 and with a second gas feeding tube 44 attached to the feeding disk 4.

The emitting disk 2 is fitted on a disk-like block plate 46 through a sealing member 45, said block plate 46 being formed with an annular channel 47 communicating with a spout 15 formed at the open end of the downstream annular channel 16.

The dispersing device according to the third embodiment is not of the type in which a gas spout is formed centrally of an annular fine particle spout as in the first embodiment. Thus, the device of this embodiment is advantageous when it is used under conditions which prevent re-agglomeration of fine particles from taking place in the interior of the jet.

Figure 8:
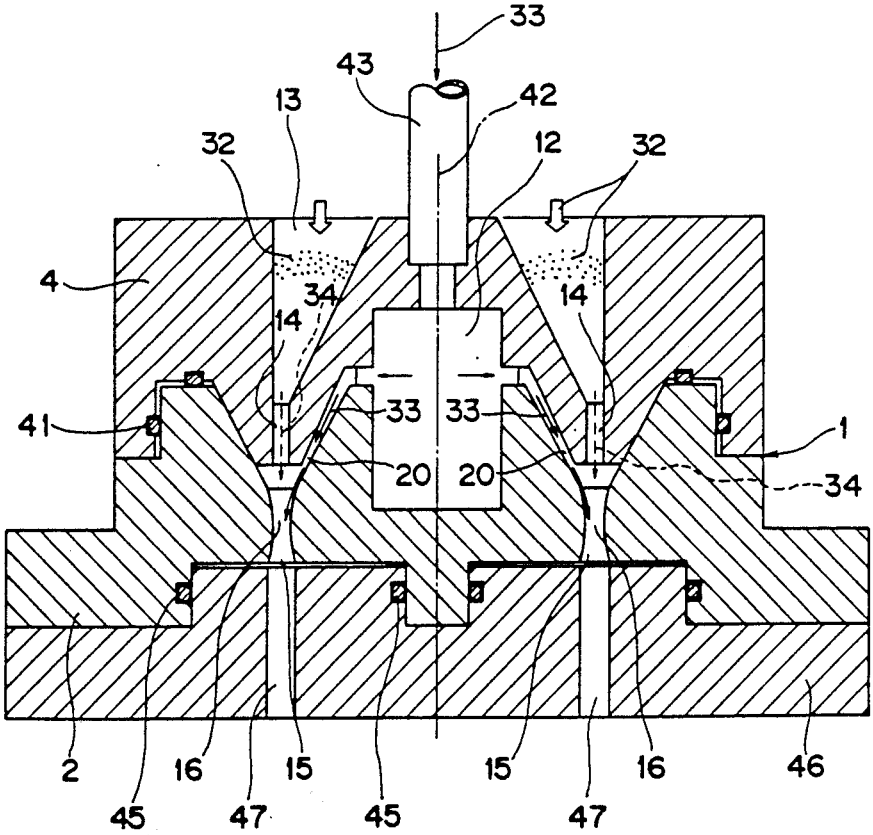
FIG. 8 is a sectional view of a dispersing device according to a fourth embodiment of the invention.

FIG. 8 shows a fourth embodiment which is a modification of the third embodiment. In this embodiment, in contrast to the third embodiment, the gas 33 is fed only from inside by omitting the construction for feeding the gas 33 from outside.

Figure 9:
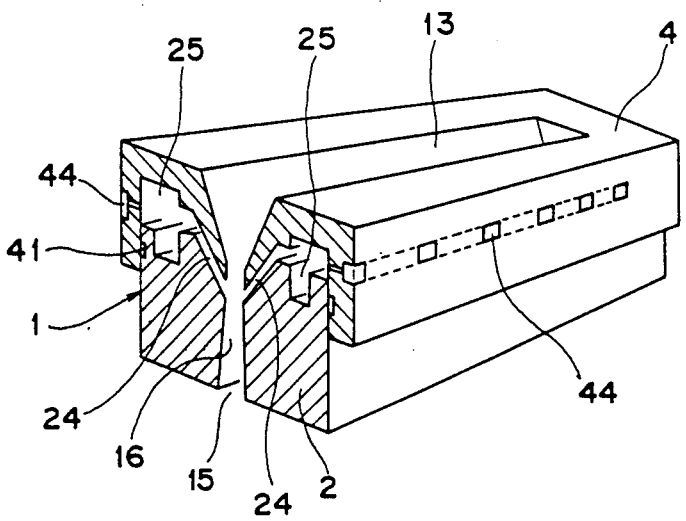
FIG. 9 is a perspective view of a dispersing device according to a fifth embodiment of the invention.
Figure 10:
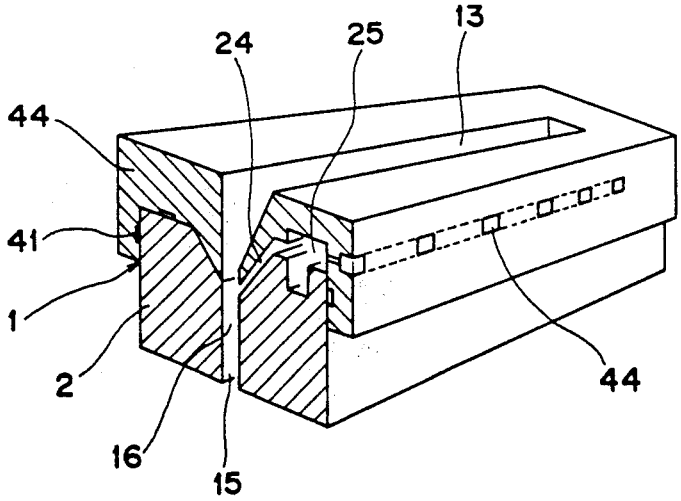
FIG. 10 is a perspective view of a dispersing device according to a sixth embodiment of the invention.

In contrast to the first through fourth embodiments in which the spout 15 and other parts are annularly formed, a fifth embodiment shown in FIG. 9 and a sixth embodiment shown in FIG. 10 have the spout 15 and other parts linearly formed.

Figure 11:
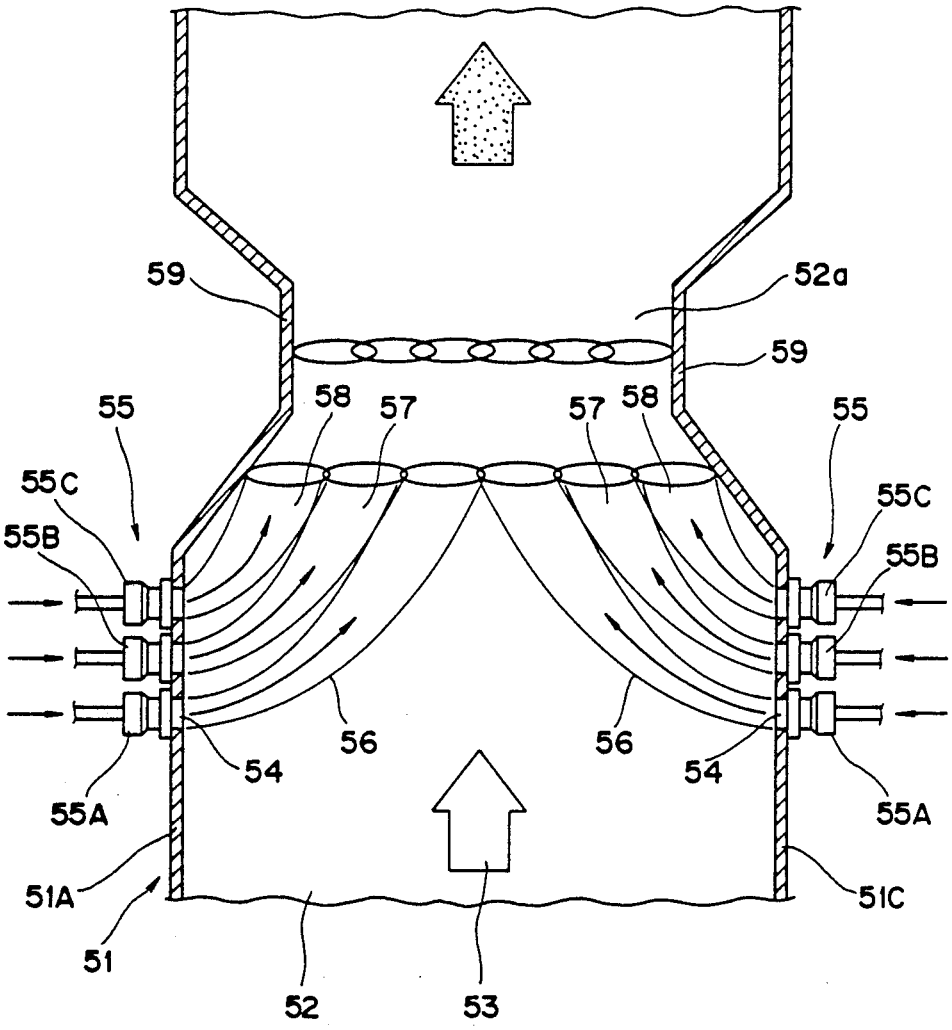
FIG. 11 is a sectional view of a first embodiment of a device for mixing a reactant with combustion gas according to the invention.

FIG. 11 shows a first embodiment of a device for mixing a reactant with combustion gas according to the invention. This is a utilization of the dispersing device described above and is employed for rapidly mixing a slight amount of reactant with combustion gas at high temperature from a furnace to effect such operations as desulfurization and non-catalytic denitration.

The numeral 51 denotes the combustion gas channel forming wall of a furnace, comprising four lateral wall portions 51A, 51B, 51C and 51D which define a combustion gas passage 52 which is quadrangular in cross section. The pair of opposed wall portions 51A and 51C are each formed with a plurality of openings 54 directed across the flow and spaced from each other in the direction of flow and in a direction perpendicular to the flow. Each opening 54 has said dispersing device 55 attached thereto. The dispersing devices 55A, 55B and 55C emit such a reactant as $CaCO_3$ in fine particle form carried by a carrier gas, forming jets 56, 57 and 58 in the combustion gas passage 52. The dispersing devices 55A, 55B and 55C are arranged so that the more upstream they are disposed, the nearer to the central portion of the combustion gas passage 52 their jets arrive. Adjustment of the throw of the jets 56, 57 and 58 can be made by changing the diameter (pitch circle) of the annular spout 15 (see FIG. 1) or the diameter of the nozzle hole 30 (see FIG. 1) for the diluting fluid. The lateral wall portions 51A and 51C of the combustion gas passage forming wall 51 are each formed with a projecting wall portion 59 disposed somewhat downstream of the dispersing devices 55, thus forming a reduced gas passage **52*a***.

In such arrangement, in treating combustion gas, jets 56, 57 and 58 are emitted from the dispersing devices 55 to combustion gas 53. At this time, the jets 56 from the upstream dispersing devices 55A arrive almost at the center of the flow of the combustion gas 53 and are eventually deflected to the direction of flow of the combustion gas 53 and dispersed in the combustion gas 53. Since the jets 57 from the dispersing devices 55B disposed downstream of the dispersing devices 55A have a shorter throw than that of the jets 56 and since they are emitted from a downstream region, they are emitted without the possibility of their centers interfering with the jets 56 and are deflected to the direction of flow of the combustion gas 53 and dispersed in the combustion gas 53. Similarly, since the jets 58 from the dispersing devices 55C have a shorter throw than that of the jets 57 and since they are emitted from a more downstream region, they are emitted without the possibility of their centers interfering with the jets 57 and are deflected to the direction of flow of the combustion gas 53 and dispersed in the combustion gas 53. As the jets 56, 57 and 58 are deflected and dispersed in the flow of the combustion gas 53, a slight amount of reactant contained in the jets can be substantially uniformly and rapidly mixed with the combustion gas 53.

Figure 12:
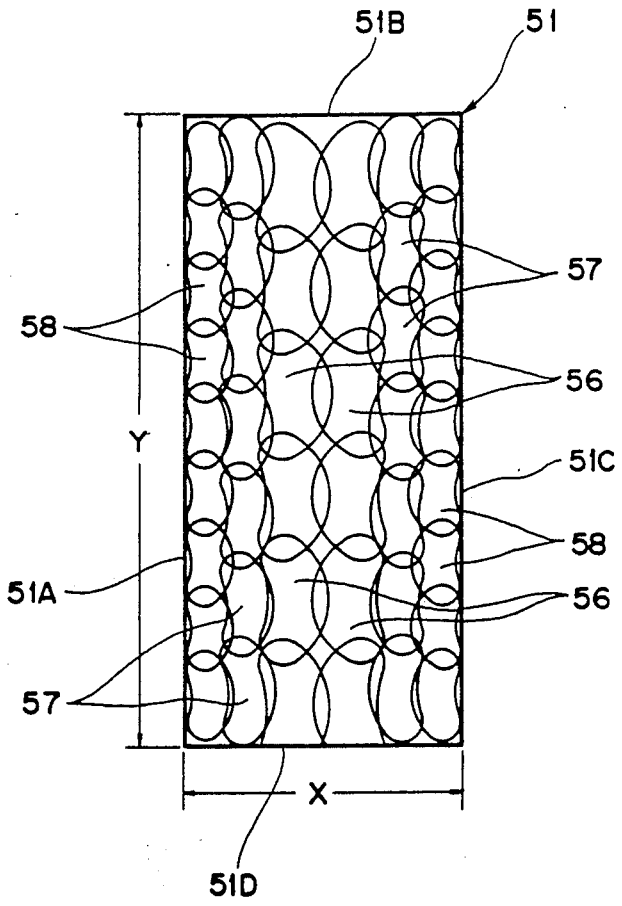
FIG. 12 is a cross-sectional view of the device shown in FIG. 11.

In FIGS. 11 and 12, the distribution of the jets 56, 57 and 58 is uniform in the direction included between the lateral wall portions 51B and 51D where the dispersing devices 55 are not disposed, i.e., in the Y-direction. However, in the X-direction, the jets 56, 57 and 58 of various sizes are combined and the distribution of the jets 56, 57 and 58 is non-uniform because of the deflection of the jets 56, 57 and 58. That is, there will be a considerable variation in the concentration of the reactant in the X-direction. To make it uniform, the projection wall portions 59 is provided to form a reduced gas passage **52*a*. The jets 56, 57 and 58 are reduced together with the combustion gas 53 subsequently to their deflection, whereby the mixing in the X-direction can be accelerated. In addition, the greater the rate of reduction, the greater the effect obtained. However, a marked mixing accelerating effect can be obtained even by making the cross-sectional area of the reduced gas passage 52*a* equal to about 60% of that of the combustion gas passage 52**.

The mixing can also be accelerated by bending the combustion gas passage 52 at a large angle instead of by reduction. In that case, bending at an angle of greater than 90 degrees is preferable.

The mixing of the jets 56, 57 and 58 described above must be effected in about 1 second, because the reaction time is about 1 second. Further, the amount of carrier gas used in emitting the reactant in a flow must be less than 10%, preferably less than 5%, of that of the combustion gas in consideration of balance in the furnace. To this end, the initial speed of the jets must be at least 100 m/sec, preferably a subsonic speed of about 300 m/sec.

Figure 13:
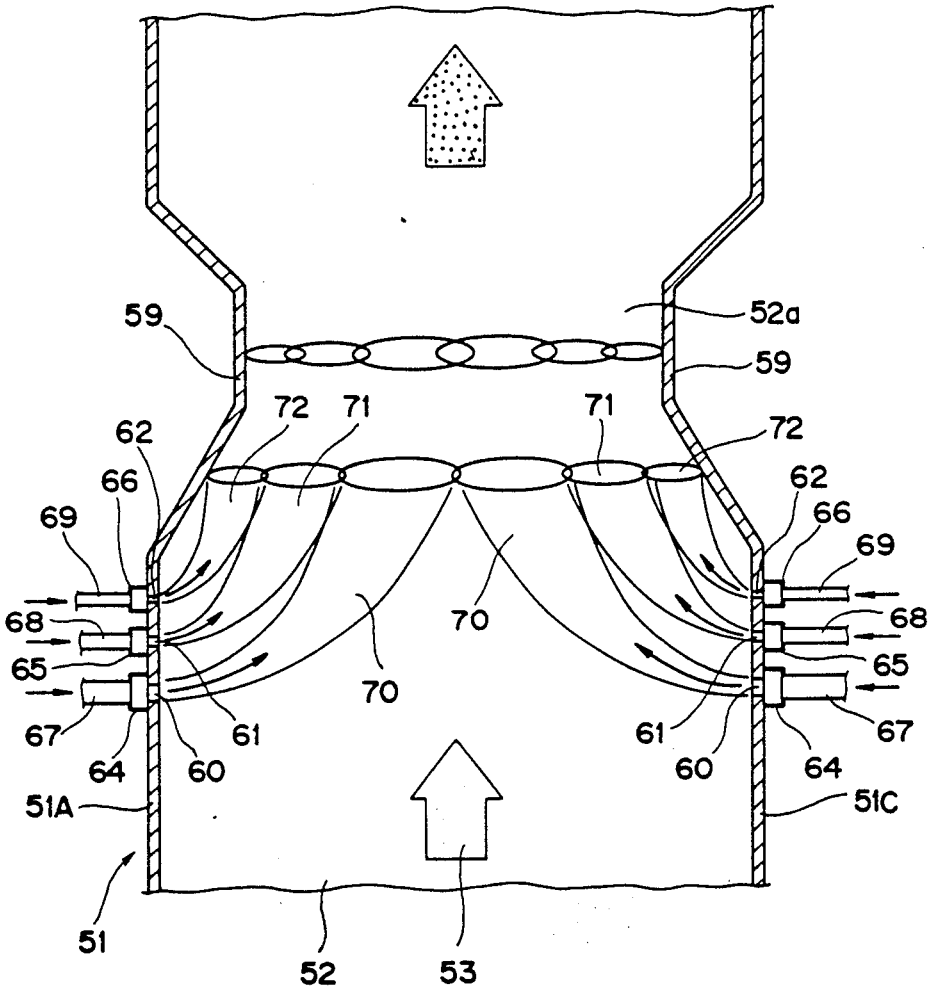
FIG. 13 is a sectional view of a second embodiment of a device for mixing a reactant with combustion gas according to the invention.
Figure 14:
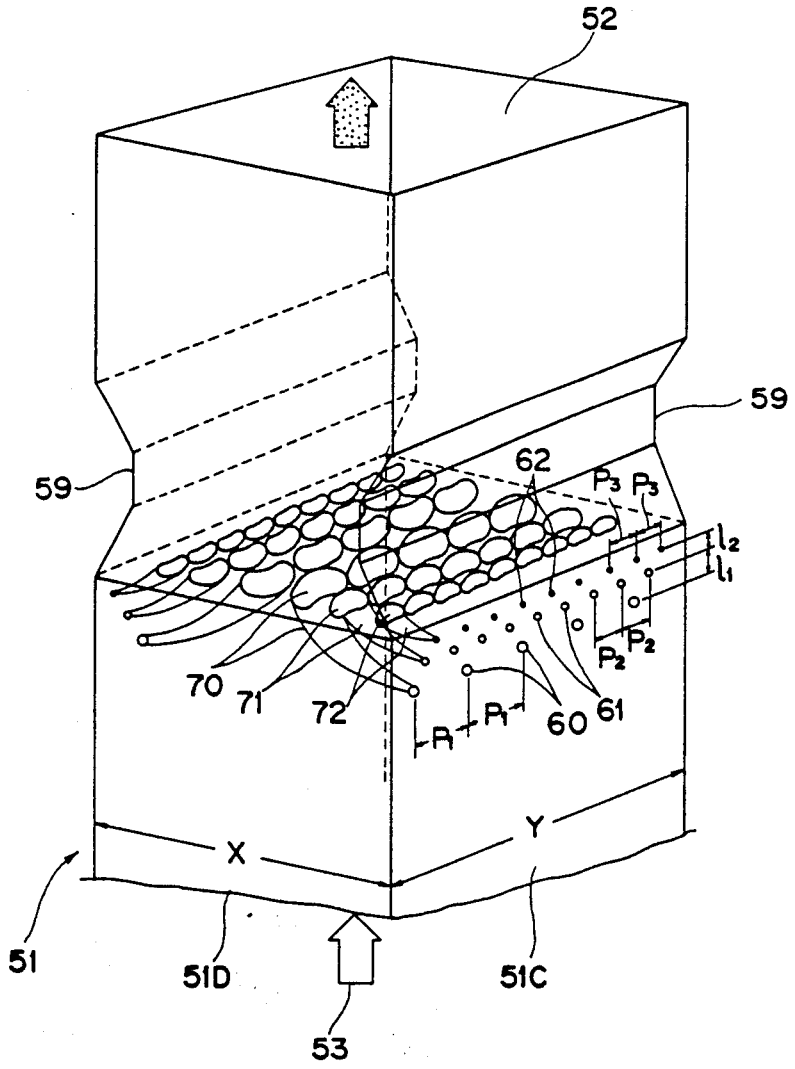
FIG. 14 is a perspective view schematically showing the arrangement of the device shown in FIG. 13.

FIGS. 13 and 14 show a second embodiment of a device for mixing a reactant with combustion gas according to the invention. In this embodiment, the lateral wall portions 51A and 51B are each formed with a plurality of spouts directed across the flow of the combustion gas 53 and spaced from each other in the direction of flow. That is, in an upstream region of flow, there are a plurality of large diameter spout 60 transversely spaced from each other with a predetermined pitch $p_1$. Disposed a predetermined distance $l_1$ downstream of the large diameter spouts 60 are a plurality of medium diameter spout 61 transversely spaced from each other with a predetermined pitch $p_2$. Disposed a predetermined distance 12 downstream of the medium diameter spouts 61 are a plurality of small diameter spouts 62 spaced from each other with a predetermined pitch $p_3$. These spouts 60, 61 and 62 are used to emit a reactant-containing gas 63 which is obtained by diluting a slight amount of such reactant as $CaCO_3$ or $NH_3$ with a carrier gas. Disposed outwardly of and associated with the respective groups of large, medium and small diameter spouts 60, 61 and 62 are ducts 64, 65 and 66 having feed tubes 67, 68 and 69 connected thereto, respectively.

According to such arrangement, large diameter spout flows 70 from the large diameter spouts 60 arrive almost at the center of the combustion gas passage 52, and it is arranged that medium diameter jets 71 from the medium spouts 61 have a shorter throw than that of large diameter jets 70 in the downstream region. Further, it is arranged that small diameter jets 72 from the small spouts 62 have shorter throw than that of the medium diameter jets 71 in the downstream region. Thus, as in the case of the embodiment shown in FIGS. 11 and 12, the reactant can be mixed with the combustion gas 53.

Figure 15:
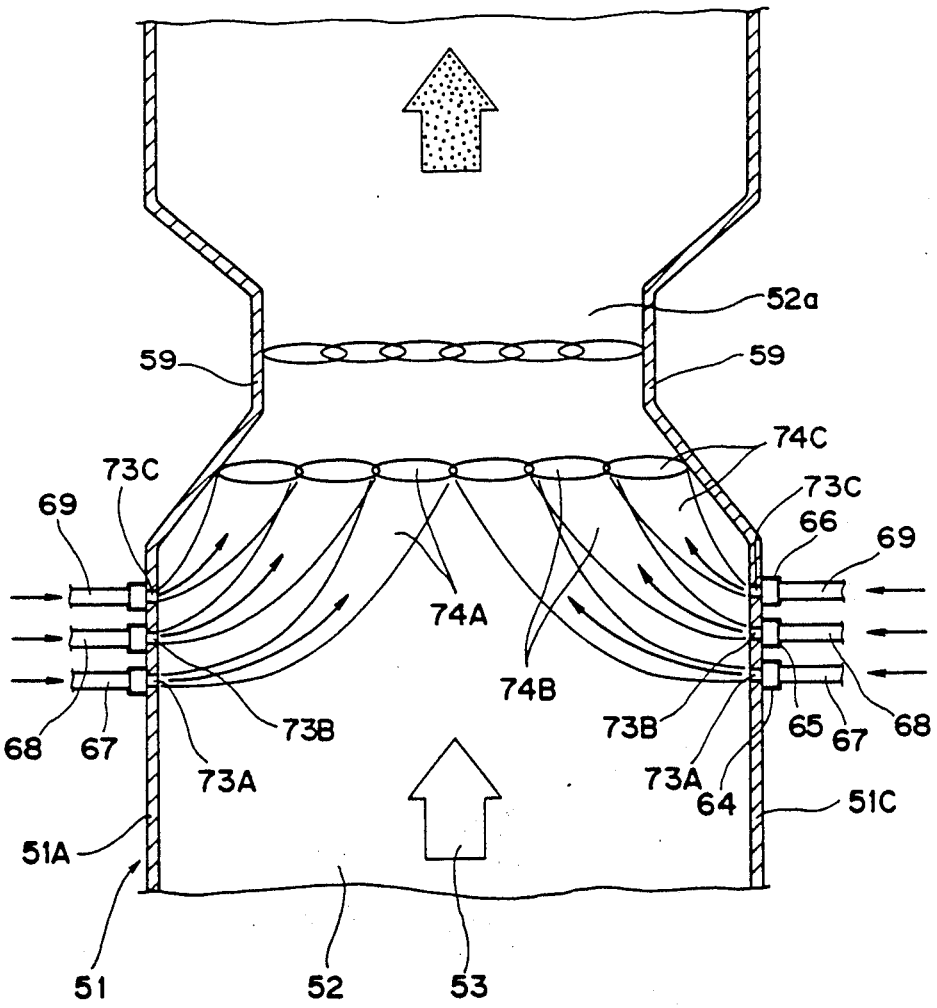
FIG. 15 is a sectional view of a third embodiment of a device for mixing a reactant with combustion gas according to the invention.

FIG. 15 shows a third embodiment of a device for mixing a reactant with combustion gas according to the invention. Spouts 73A, 73B and 73C of the same diameter are used. In this case, it is arranged that the spouts 73A in the upstream region emit jets 74A at a high initial speed, that the spouts 73B in the intermediate region emit jets 74B at a medium initial speed and that the spouts 73C in the downstream region emit jets 74C at a low initial speed.

Further, a suitable combination of jet diameters and initial jet speeds may be used to attain uniform mixing of a slight amount of reactant with combustion gas 53 without causing the axes of the jets to interfere with each other.

The throw L of jets and the time t taken for jets to cover the throw depend on jet diameter (nozzle diameter) d, initial jet speed $U_o$ and combustion gas flow rate $U_1$.

In the reactant mixing device shown in FIGS. 13 and 14, from the facts that the rate of emission from the large diameter spouts 60 is the highest and that the rate of emission from the small diameter spouts 62 is the lowest, the number of large diameter spouts 60 is small and the number of small diameter spouts 62 is large. That is, the relationship of the pitches is that $p_1 > p_2 > p_3 \ldots > p_n$.

The combustion gas in the furnace flows from the inlet to the outlet, when seen from a macroscopic point of view, but its distribution of flow differs from cross section to cross section of the furnace and is very complicated. That is, the gas flows fast in one location and slowly in another and locally it sometimes flows back. Thus, in practice, in installing nozzle devices in the wall of a furnace, the angles and positions at which the nozzles are attached to the furnace wall are adjusted by reference to flow patterns of combustion gas in the furnace to reduce the influences of such combustion gas flow pattern on the spread of jets in the cross section of the furnace.

Two experimental examples I and II are given below.

EXPERIMENTAL EXAMPLE I

Dimensional relationship: for example, when a large-sized furnace was 9 m in the X-direction and 14 m in the Y-direction, four types of spouts with a diameter d=0.006 m, 0.01 m, 0.018 m and 0.03 m, respectively, were arranged in the lateral wall portions 51A and 51C in the following manner.

Seven spouts with d=0.03 m were disposed with a pitch $p_1$=2.00 m in the most upstream region; 11 spouts with d=0.018 m were disposed with a pitch $p_2$=1.25 m and a distance $l_1$=2.1 m downstream; 20 spouts with d=0.01 m were disposed with a pitch $p_3$=0.7 m and a distance $l_2$=1.1 m further downstream, and 35 spouts with d=0.006 m were disposed with a pitch $p_4$=0.4 m and a distance $l_3$=0.6 m further downstream. The region which was downstream of the spouts of 0.006 m in diameter was reduced by 3 m in the X-direction to provide a length of 6 m in the X-direction. When the combustion gas was flowing in the channel at an average speed $U_1$=5 m/sec, a carrier gas containing a reactant was emitted from each spout at an initial speed $U_o$=200 m/sec. As a result, a substantially uniform mixing state was obtained over the entire region of the combustion gas passage 52 within t=0.5 sec.

EXPERIMENTAL EXAMPLE II

Dimensional relationship: for example, when a large-sized furnace was 15 m in he X-direction and 20 m in the Y-direction, 5 types of spouts with a diameter d=0.006 m, 0.01 m, 0.018 m, 0.03 m and 0.05 m respectively, were arranged in the lateral wall portions 51A and 51C in the following manner.

Six spouts with d=0.005 m were disposed with a pitch $p_1$=3.3 m in the most upstream region; 10 spouts with d=0.03 m were disposed with a pitch $p_2$=2.0 m and a distance $l_1$=3.2 m downstream; 16 spouts with d=0.018 m were disposed with a pitch $p_3$=1.25 m and a distance $l_2$=2.1 m further downstream; 29 spouts with d=0.001 m were disposed with a pitch $p_4$=0.7 m and a distance $l_3$=1.1 m further downstream; and 50 spouts with d=0.006 m were disposed with a pitch $p_5$=0.4 m and a distance $l_4$=0.6 m further downstream. The region which was downstream of the spouts of 0.006 m in diameter in the most downstream region was reduced by 5 m in the X-direction to provide a length of 10 m in the X-direction. When the combustion gas was flowing in the channel at an average speed $U_1$ =5 m/sec, a carrier gas containing a reactant was emitted from each spout at an initial speed $U_o$=200 m/sec. As a result, a substantially uniform mixing state was obtained over the entire region of the combustion gas passage 52 within t=1–2 sec. In this manner, the number of spouts and the number of stages are determined by he size and shape of the furnace to provide an optimum result.

What is claimed is:

1. A dispersing device comprising a body, a fine particle channel provided in said body, terminating in a spout in the form of an annular slit and having inner and outer peripheral sides, and gas clearances provided on both said inner and outer peripheral sides of the fine particle channel, inclined downstream with respect to said fine particle channel and communicating with said fine particle channel for emitting a gas into said fine particle channel.

2. A dispersing device as set forth in claim 1, wherein the annular spout is centrally provided with a gas spout.

3. A dispersing device as set forth in claim 2, wherein the gas spout and the inner peripheral gas clearance communicate with common gas feeding means.

4. A dispersing device as set forth in claim 2, wherein the inner and outer peripheral gas clearances are connected to common gas feeding means, while the gas spout is connected to another gas feeding means.

5. A dispersing device comprising a body, a fine particle channel provided in said body, terminating in a spout in the form of a linear slit and having one and another sides, and gas clearances provided on both said sides of the fine particle channel, inclined downstream with respect to said fine particle channel and communicating with said fine particle channel for emitting gas into said fine particle channel.

6. A device for mixing a reactant with combustion gas, comprising a plurality of dispersing means capable of emitting reactant-containing gas in a direction which crosses the direction of flow of the combustion gas, said dispersing means being provided in the combustion gas passage forming wall of a furnace so that they are spaced from each other in the direction of flow, said dispersing means being capable of emitting the reactant-containing gas in such a manner that the more upstream they are disposed, the greater is their throw, wherein each of said dispersing means comprises a body, a fine particle channel provided in said body, terminating in a spout in the form of an annular slit and having inner and out peripheral sides, and gas clearances provided on both said inner and outer peripheral sides of the fine particle channel, inclined downstream with respect to said fine particle channel and communicating with said fine particle channel for emitting said gas into said fine particle channel.

7. A device for mixing a reactant with combustion gas as set forth in claim 6, wherein the annular spout is centrally provided with a gas spout.

8. A device for mixing a reactant with combustion gas, comprising a plurality of dispersing means capable of emitting reactant-containing gas in a direction which crosses the direction of flow of the combustion gas, said dispersing means being provided in the combustion gas passage forming wall of a furnace so that they are spaced from each other in the direction of flow, said dispersing means being capable of emitting the reactant-containing gas in such a manner that the more upstream they are disposed, the greater is their throw, wherein each of said dispersing means comprises a body, a fine particle channel provided in said body, terminating in a spout in the form of an annular slit and having inner and outer peripheral sides and a gas clearance provided either on said inner or outer peripheral side of the fine particle channel, inclined downstream with respect to said fine particle channel and communicating with said fine particle channel for emitting said gas into said fine particle channel.

9. A device for mixing a reactant with combustion gas as set forth in claim 8, wherein the annular spout is centrally provided with a gas spout.

10. A device for mixing a reactant with combustion gas, comprising a plurality of dispersing means capable of emitting reactant-containing gas in a direction which crosses the direction of flow of the combustion gas, said dispersing means being provided in the combustion gas passage forming wall of a furnace so that they are spaced from each other in the direction of flow, said dispersing means being capable of emitting the reactant-containing gas in such a manner that the more upstream they are disposed, the greater is their throw, wherein each of said dispersing means comprises a body, a fine particle channel provided in said body, terminating in a spout in the form of a linear slit and having one and another sides, and gas clearances provided on both said sides of the fine particle channel, inclined downstream with respect to said fine particle channel and communicating with said fine particle channel for emitting said gas into said fined particle channel.

11. A device for mixing a reactant with combustion gas, comprising a plurality of dispersing means capable of emitting reactant-containing gas in a direction which crosses the direction of flow of the combustion gas, said dispersing means being provided in the combustion gas passage forming wall of a furnace so that they are spaced from each other in the direction of flow, said dispersing means being capable of emitting the reactant-containing gas in such a manner that the more upstream they are disposed, the greater is their throw, wherein each of said dispersing means comprises a body, a fine particle channel provided in said body, terminating in a spout in the form of a linear slit and having one and another sides, and a gas clearance provided either on one or the other of said sides of the fine particle channel, inclined downstream with respect to said fine particle channel and communicating with said fine particle channel for emitting said gas into said fine particle channel.

12. A device for mixing a reactant with combustion gas, comprising a plurality of dispersing means capable of emitting reactant-containing gas in a direction which crosses the direction of flow of the combustion gas, said dispersing means being provided in the combustion gas passage forming wall of a furnace so that they are spaced from each other in the direction of flow, said dispersing means being capable of emitting the reactant-containing gas in such a manner that the more upstream they are disposed, the greater is their throw, wherein said dispersing means are spouts which are disposed at a plurality of locations, said spouts having their diameters determined such that the largest diameter is imparted to those spouts which are disposed in the upstream region while progressively reduced diameters are imparted to the other spouts as the latter are disposed progressively downstream.

13. A device for mixing a reactant with combustion gas, comprising a plurality of dispersing means capable of emitting reactant-containing gas in a direction which crosses the direction of flow of the combustion gas, said dispersing means being provided in the combustion gas passage forming wall of a furnace so that they are spaced from each other in the direction of flow, said dispersing means being capable of emitting the reactant-containing gas in such a manner that the more upstream they are disposed, the greater is their throw, wherein said dispersing means are spouts which are disposed at a plurality of locations, and wherein of these spouts, those which are disposed upstream in the direction of flow of combustion gas emit the reactant-containing gas under a high pressure while the pressure at which the reactant-containing gas is emitted is progressively reduced as the locations of the spouts become more downstream.

14. A dispersing device comprising a body, a fine particle channel provided in said body, terminating in a spout in the form of an annular slit and aving inner and outer peripheral sides, and a gas clearance provided either on said inner or outer peripheral side of the particle channel, inclined downstream with respect to said fine particle channel and communicating with said fine particle channel for emitting a gas into said fine particle channel, said annular spout being centrally provided with a gas spout, and said gas spout and said gas clearance communicating with common gas feeding means.

* * * * *